US007625305B2

(12) United States Patent
Lancisi

(10) Patent No.: US 7,625,305 B2
(45) Date of Patent: Dec. 1, 2009

(54) TRAINING BAT

(76) Inventor: Paul F. Lancisi, 32 Wilder Davis Rd., Bradford, ME (US) 04410

( * ) Notice: Subject to any disclaimer, the term of this patent is extended or adjusted under 35 U.S.C. 154(b) by 430 days.

(21) Appl. No.: 11/688,282

(22) Filed: Mar. 20, 2007

(65) Prior Publication Data

US 2008/0234075 A1 Sep. 25, 2008

(51) Int. Cl.
*A63B 69/40* (2006.01)
*A63B 69/00* (2006.01)

(52) U.S. Cl. ..... 473/457; 473/422

(58) Field of Classification Search ..... 473/457, 473/437, 422, 558, 559, 564–567
See application file for complete search history.

(56) References Cited

U.S. PATENT DOCUMENTS 3,129,003 A * 4/1964 Mueller et al. ..... 473/568
3,246,894 A * 4/1966 Salisbury ..... 473/457
3,618,945 A 11/1971 Kuchar
3,623,724 A * 11/1971 Lande ..... 473/437
4,819,935 A * 4/1989 Dirksing et al. ..... 482/109
5,273,278 A * 12/1993 Becker ..... 473/457
5,676,609 A * 10/1997 Møllebaek ..... 473/564
5,722,908 A 3/1998 Feeney et al.
5,980,397 A 11/1999 Hart et al.
6,045,465 A 4/2000 Alfano et al.
6,093,114 A 7/2000 Haringa

* cited by examiner

*Primary Examiner*—Mitra Aryanpour
(74) *Attorney, Agent, or Firm*—Anthony D. Pellegrini, Esq.

(57) ABSTRACT

An improved training bat having training assemblies affixed thereto on either side of the preferred hitting region of the bat, said assemblies constructed of a rigid, durable material which, when struck by a ball, emit a sound different from the sound emitted by the preferred hitting region of the bat when struck by the same ball, such that a batter using the improved training bat will immediately recognize by the sound made whether a ball contacted by the improved training bat was properly hit; and a method of constructing same.

20 Claims, 7 Drawing Sheets

TRAINING BAT

BACKGROUND OF THE INVENTION

1. Technical Field

The present invention relates generally to the field of sporting goods and specifically to the field of training bats for use in teaching baseball and softball batters to hit a ball with the preferred portion of a bat. The present invention also discloses a method for constructing an improved training bat.

2. Description of Prior Art

The use of training bats is well known in the art. Many different attempts have been made to train batters to strike a ball with the preferred portion of a bat. For example, U.S. Pat. No. 6,045,465, to Alfano, et al. (Apr. 4, 2000), discloses a baseball training bat with colored transferable bands. The bands are placed over the preferred hitting region of the bat. When a ball is struck on the preferred hitting region of the bat colored pigment transfers to the ball. While this configuration gives an accurate sense of where on the bat the ball made contact, it is inefficient in that visual inspection of the ball must be made after it is retrieved, introducing a delay between the moment of contact and the discovery of whether the contact was proper. This lessens the effectiveness of the training. This configuration also requires constant cleaning of the ball to remove prior pigment. Because this configuration places the training material over the preferred hitting portion of the bat, it also creates an unnatural feel when a ball is contacted properly, which may serve to undermine the training goal.

U.S. Pat. No. 6,093,114, to Haringa (Jul. 25, 2000), discloses a batting practice attachment for baseball bats. The attachment is a sleeve which is placed over the end of a bat so that the preferred hitting region is covered. While this configuration creates a different sound between contacting a ball with the preferred region compared to contacting a ball with a non-preferred region, this configuration also places the training material over the preferred hitting portion of the bat, creating an unnatural feel when a ball is contacted properly, with the same detrimental effect on the training goal as described above. Moreover, the forward portion of the sleeve creates a raised edge on the surface of the bat. A ball striking the bat at the forward portion of the sleeve may be deflected towards the batter, an undesirable and dangerous result.

U.S. Pat. No. 3,618,945, to Kuchar (Nov. 9, 1971), discloses a baseball training bat in which the areas above and below the preferred hitting area are formed with a cushioning material. This configuration results in a different sound being emitted from contacting a ball with the preferred area than contacting a ball with a non-preferred area. However, because the non-preferred area is covered by a cushioning material, it will compress when struck by a ball. Should the ball contact the bat at the junction of the preferred and non-preferred hitting areas, the compression of the cushioning material at this junction will expose a sharp angle at the edge of the non-compressed preferred hitting area, thereby creating a significant danger of deflecting the ball towards the batter. Moreover, the cushioning material adds no rigidity to the bat, so that the weakness introduced to the bat, in the form of angled inside corners within the annular depressions used to prepare the bat to accept the cushioning material, remains and the bat is more susceptible to breakage than a standard bat.

There is therefore a need for an improved training bat which provides immediate feedback to the batter while minimizing the danger of deflections of struck balls or accelerated breakage of the bat.

It is therefore an objective of this invention to provide an improved training bat which emits a different sound when struck by a ball on the preferred hitting region compared with being struck by a ball on a non-preferred region.

It is a further objective of this invention to provide an improved training bat which does not interpose any material between the ball and the preferred hitting region.

It is yet a further objective of this invention to provide an improved training bat which has a substantially smooth surface and does not introduce projections, ridges, bumps, angles, or other irregularities into its surface, thereby minimizing the danger of deflections of struck balls.

It is yet a further objective of this invention to provide an improved training bat that is not weakened by introduction of the training means.

It is yet a further objective of this invention to provide an improved training bat that emulates the weight-to-length ratio of aluminum bats.

It is yet a further objective of this invention to provide a method of constructing an improved training bat.

Other objectives of this invention will be evident from the following disclosure.

SUMMARY

The present invention is directed to an improved training bat which is used to train baseball and softball batters to hit a ball with the preferred part of a bat. The improved training bat utilizes different sounds to inform the batter whether a ball struck by the improved training bat is being contacted with the preferred region of the improved training bat. That is, a ball contacting the preferred region of the improved training bat will make one sound, while a ball contacting other regions of the improved training bat will make a different sound. The use of sound to train a batter allows for immediate feedback on whether a ball is being struck properly, both to the batter and to any instructor observing the batter.

The improved training bat performs the above described function by having affixed thereon one or more training assemblies, which are fitted over the non-preferred regions of the improved training bat. The preferred hitting region is left uncovered. The training assemblies are constructed of a rigid, durable material which emits a sound when struck by a ball different from the sound emitted by the preferred hitting region when struck by the same ball. The rigidity of the training assemblies minimizes distortion in the surface of the improved training bat upon contact with a ball. This is especially significant at the junctions of the training assemblies and the uncovered regions of the improved training bat. A ball contacting such a junction will strike a substantially smooth surface, thereby greatly reducing the risk of a deflection of the ball towards the batter. The improved training bat may have a core constructed of any suitable material, such as wood, aluminum, fiberglass, graphite, or a composite material.

The improved training bat also closely emulates the characteristics of the most commonly used bats. Aluminum bats are more commonly used than wooden bats at all levels of baseball and softball play other than for Major League Baseball. Wooden bats are heavier than aluminum bats for a given length. Aluminum bats also cause the ball to travel a further distance given the same amount of force upon contact. The improved training bat can achieve the weight-to-length ratio of standard aluminum bats even if constructed of wood by incorporating weight saving construction. Because the improved training bat can be constructed of wood yet still achieve the same weight-to-length ratio as an aluminum bat, a batter using the improved training bat can train using a properly weighted bat but will be encouraged to swing harder to hit the ball the desired distances. Alternatively, when the improved training bat is constructed of aluminum or another material, the training assemblies may be constructed of a material with a similar density, thereby leaving the final weight of the improved training bat unchanged.

The method of constructing an improved training bat involves creating circumferential depressions in the improved training bat in the regions to be covered by the training assemblies, then forming the training assemblies thereon. The circumferential depressions are formed to comprise smooth transition zones to the other regions of the improved training bat, to prevent the introduction of stress points in the improved training bat. An optional end depression can be formed into the improved training bat to lessen its overall weight.

Other features and advantages of the invention are described below.

DETAILED DESCRIPTION OF THE INVENTION

Figure 1:
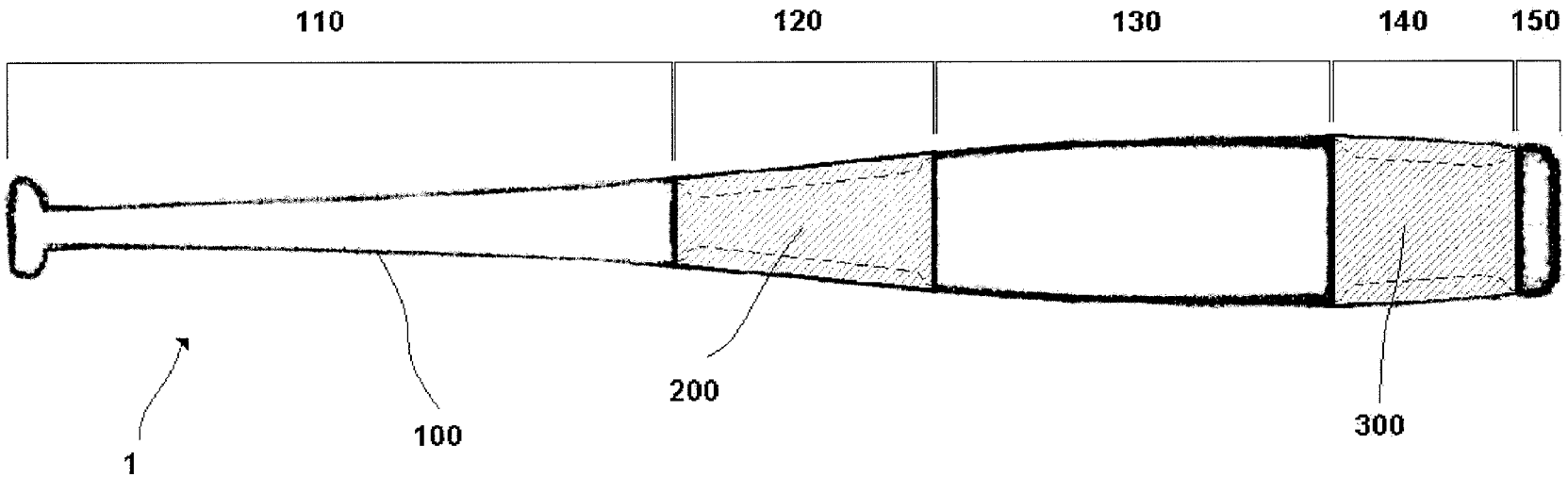
FIG. 1 is a plan view of the improved training bat.

The present invention is an improved training bat 1. The improved training bat 1 comprises a batting core 100 and at least one training assembly formed onto and affixed to the batting core 100. The batting core 100 is a modified traditional baseball or softball bat. It is substantially elongate, cylindrical, and tapered. The batting core 100 may be constructed of traditional woods used for baseball bats, such as ash or maple, or may be constructed of aluminum, fiberglass, graphite, or a composite material. For descriptive purposes, the batting core 100 is divided into five regions, running from the narrow handle end to the wider hitting end. These regions are designated the handle region 110, the intermediate region 120, the hitting region 130, the terminal region 140, and the end cap 150. See FIG. 1. In this configuration the improved training bat 1 comprises two training assemblies. In an alternative embodiment, the batting core 100 is divided into only three regions, designated the handle region 110, the intermediate region 120, and the hitting region 130, which extends all the way to the end of the batting core 100. In this configuration the improved training bat 1 comprises only one training assembly.

The hitting region 130 is the portion of the batting core 100 generally known as the barrel of the bat, or the "sweet spot". It is that portion of the bat 1 which a batter desires to bring in contact with a ball 10 to achieve the greatest distance and directional accuracy. The improved training bat 1 is designed to teach batters to use the hitting region 130 to contact the ball 10 rather than other portions of the bat 1. Because the hitting region 130 is the intended point of contact with the ball 10 it does not receive any special adaptation in the improved training bat 1 as compared with traditional bats.

The handle region 110 is the portion of the batting core 100 gripped by a batter when using the improved training bat 1. It is the narrowest portion of the improved training bat 1. Typically, the free end of the handle region 110 will comprise a solid disk having a diameter greater than the diameter of the end of the handle region 110. While it is not desired to contact balls 10 with the handle region 110, the location of the handle region 110 at one end of the improved training bat 1 and the presence of the batter's hands over most of the handle region 110 eliminate the need for any special adaptation of this region as compared with traditional bats.

The end cap 150 is the end of the batting core 100 opposite the handle region 110. It is generally rounded and constitutes a relatively small portion of the overall batting core 100. A ball 10 coming into contact with the end cap 150 of the batting core 100 will typically deflect away from the batter, giving an immediate indication that an improper portion of the batting core 100 was used to contact the ball 10. Thus, the end cap 150 requires no special adaptation in the improved training bat 1. In the alternative embodiment the end cap 150 is not a separate region but merely comprises the outer end of the hitting region 130.

The intermediate region 120 is the portion of the batting core 100 located between the handle region 110 and the hitting region 130. This region is not intended to be used to contact a ball 10, and it is one purpose of the improved training bat 1 to teach batters not to contact balls 10 with the intermediate region 120 of the improved training bat 1. The intermediate region 120 is therefore specially adapted in the improved training bat 1, as further described below.

The terminal region 140 is the portion of the batting core 100 located between the hitting region 130 and the end cap 150. This region, constituting a relatively small portion of the overall batting core 100, is also not intended to be used to contact a ball 10. It is therefore another purpose of the improved training bat 1 to teach batters not to contact balls 10 with the terminal region 140 of the improved training bat 1. The terminal region 140 is also specially adapted in the improved training bat 1, as further described below. In the alternative embodiment there is no terminal region 140.

Figure 4:
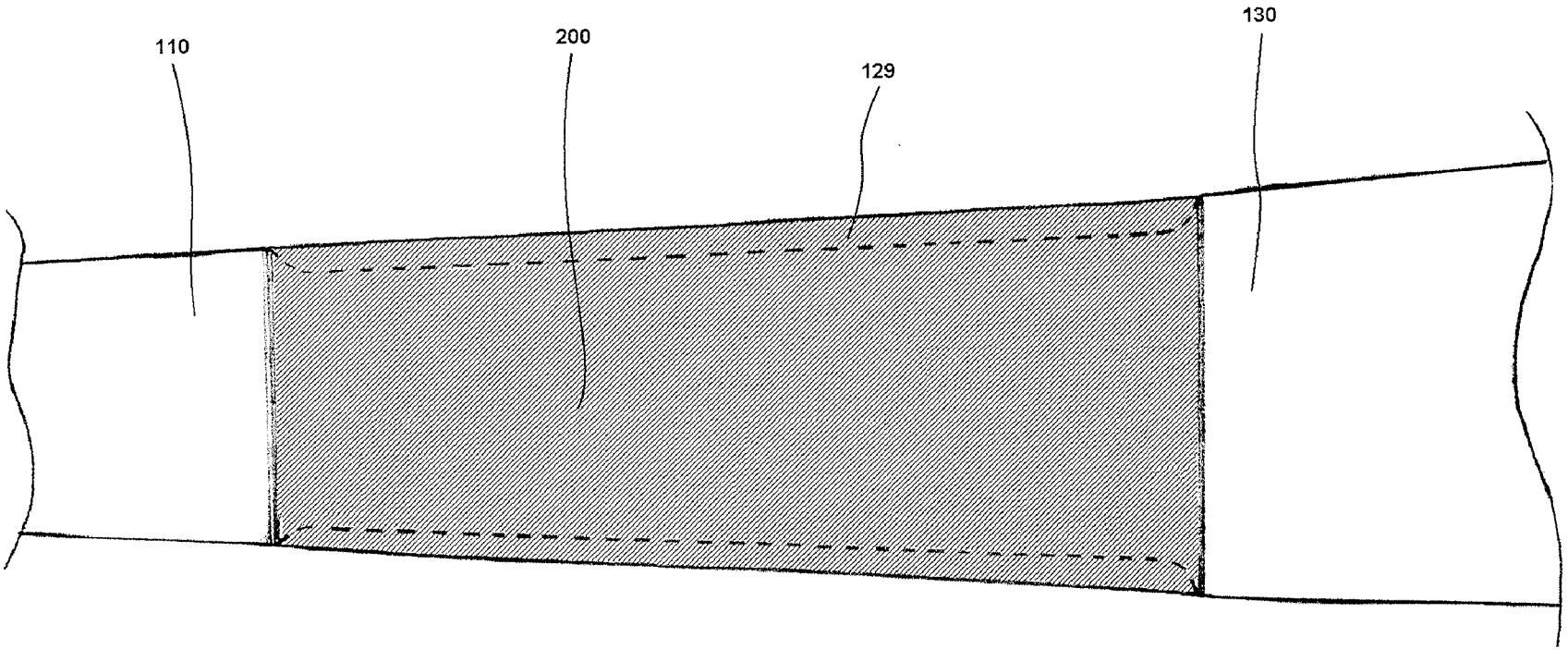
FIG. 4 is a partial plan view of the intermediate region of the improved training bat depicting the first training assembly positioned over the intermediate region.
Figure 5:
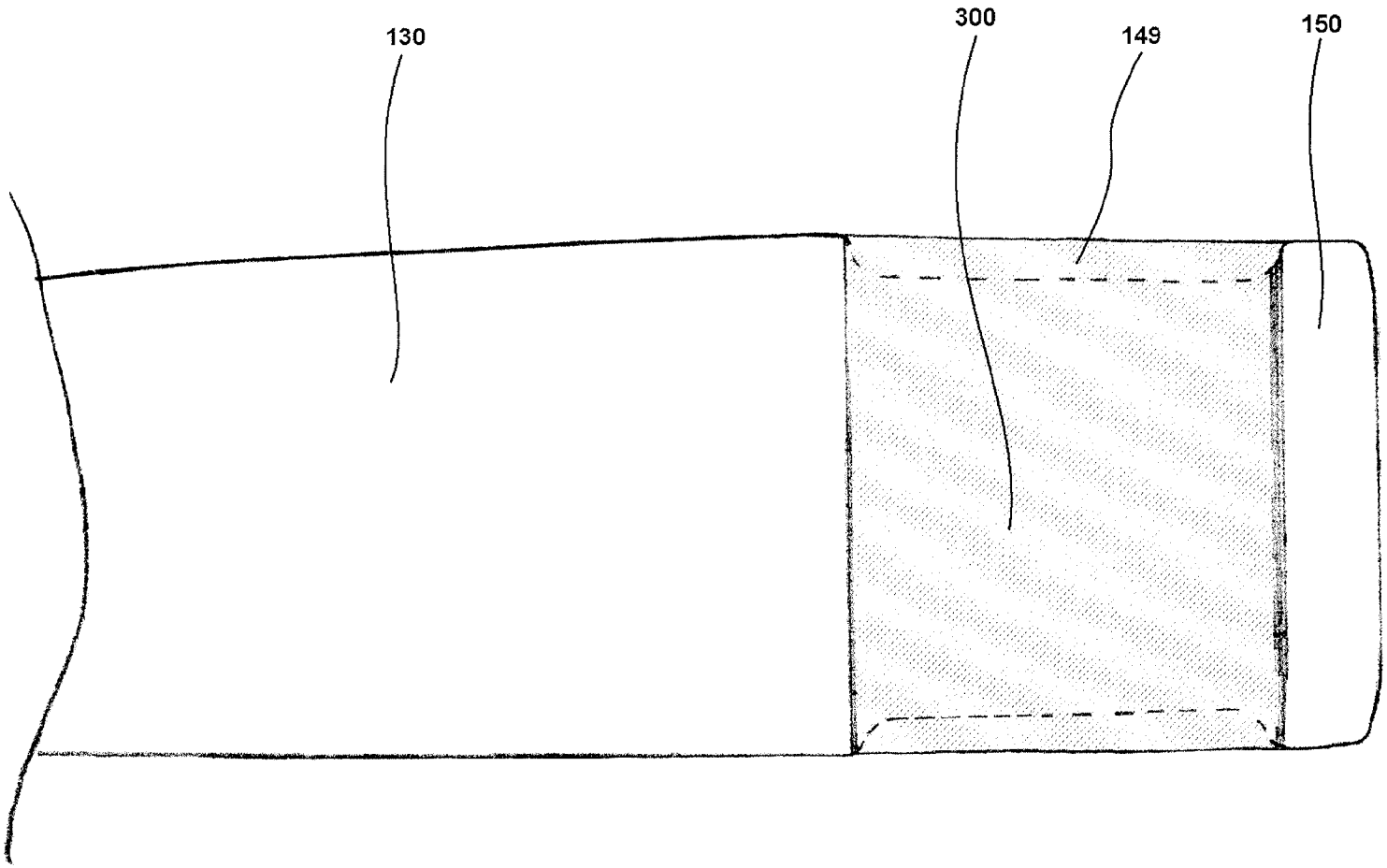
FIG. 5 is a partial plan view of the terminal region of the improved training bat depicting the second training assembly positioned over the terminal region.
Figure 6:
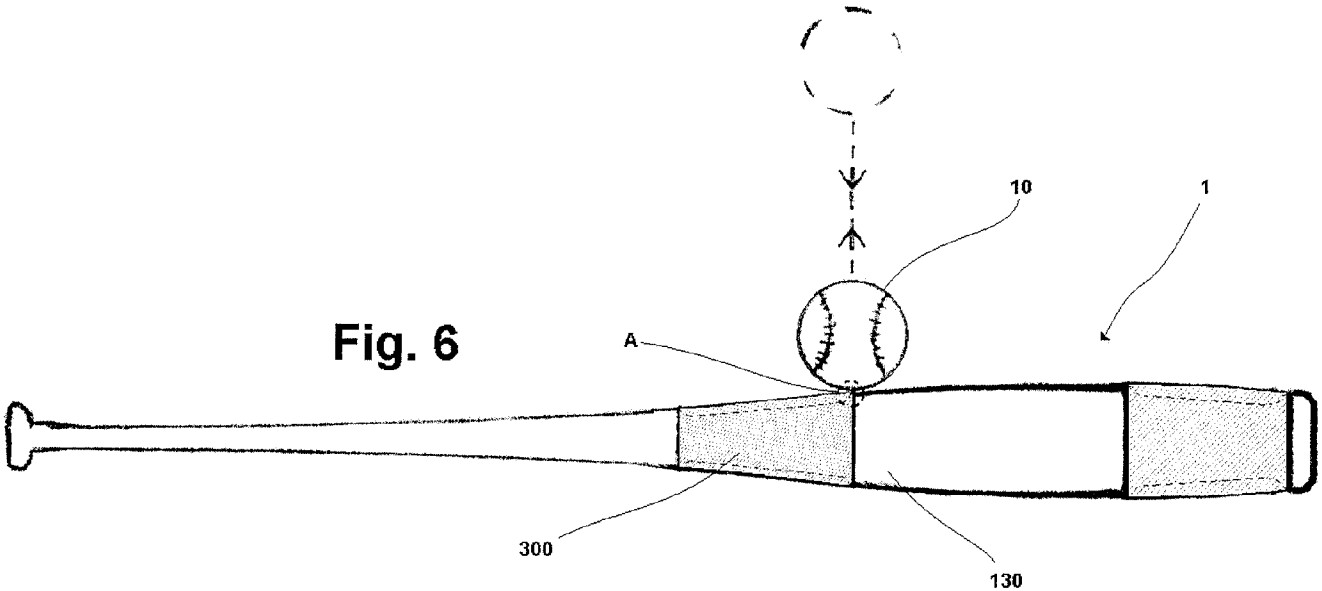
FIG. 6 is a plan view of the improved training bat in use.
Figure 6A:
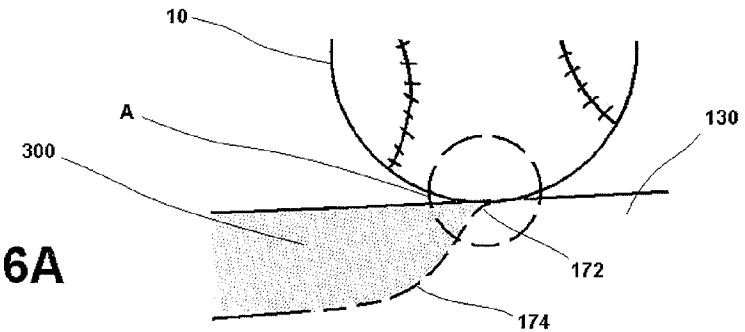
FIG. 6A is a close up plan view of the improved training bat depicted in FIG. 6, depicting the point of contact between the improved training bat and a ball.
Figure 7A:
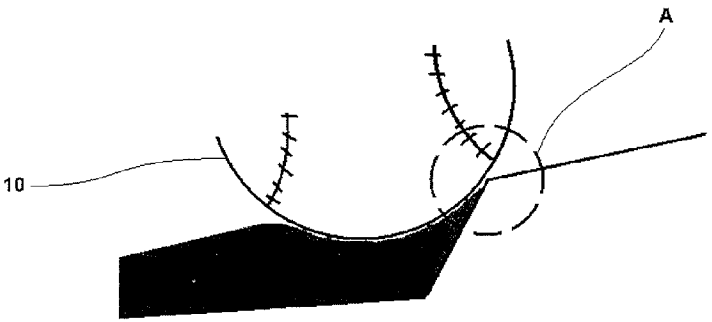
FIG. 7A is a close up plan view of the prior art training bat depicted in FIG. 7, depicting the point of contact between the prior art training bat and a ball.
Figure 7:
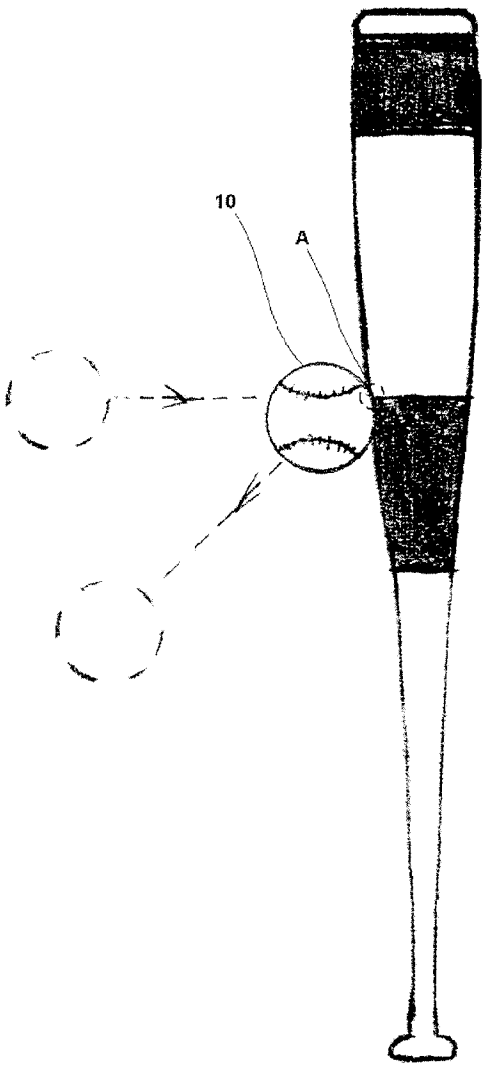
FIG. 7 is a plan view of a prior art training bat in use.

In order to achieve the purposes of teaching batters not to contact balls 10 with the intermediate region 120 or the terminal region 140 of the improved training bat 1, the improved training bat 1 further comprises a first training assembly 200 and a second training assembly 300. Each training assembly 200, 300 is constructed of a durable, rigid material which, when struck by a ball 10, emits a sound different from the sound emitted by the batting core 100 when struck by the same ball 10. The first training assembly 200 is located over the intermediate region 120, see FIG. 4, and the second training assembly 300 is located over the terminal region 140, see FIG. 5. When affixed to the batting core 100, the first and second training regions create, in conjunction with the remaining portions of the batting core 100, a smooth, continuous surface from the handle region 110 to the hitting region 130 to the end cap 150, thus presenting a profile substantially identical to that of a traditional bat. Not only is this aesthetically pleasing, but it also eliminates the dangers inherent when sharp edges, corners, protrusions, seams, and the like are present on the surface of a bat. See FIG. 6. Where such are present, a ball 10 striking same is easily deflected, often towards the batter, resulting in potentially grave injury to the batter. See FIG. 7.

A batter using the improved training bat 1 learns to contact the ball 10 only with the hitting region 130 because of the difference in sounds produced by the ball 10 contacting the hitting region 130 compared with the ball 10 contacting the training assemblies 200,300. Auditory instruction is significant, because it is very difficult to visually note exactly where on a bat contact is made with the ball 10. Moreover, in many cases, a ball 10 contacted with the intermediate region 120 or the terminal region 140 of a bat will travel relatively accurately and achieve distances of travel similar to (though inferior to) that achieved by properly contacting a ball 10 with the hitting region 130. Without the auditory means for detecting the region of contact, a batter is often unable to determine whether proper contact on a bat is being made. Instructors assisting batters have the same difficulty in determining where contact on a bat is made. The distinct sounds generated by the improved training bat 1 by contact with the proper and improper regions provide instructors with accurate knowledge of the batter's hitting. Multiple batters can be simultaneously observed by a single instructor, with the audible warning directing the instructor to the batter needing assistance.

Figure 2:
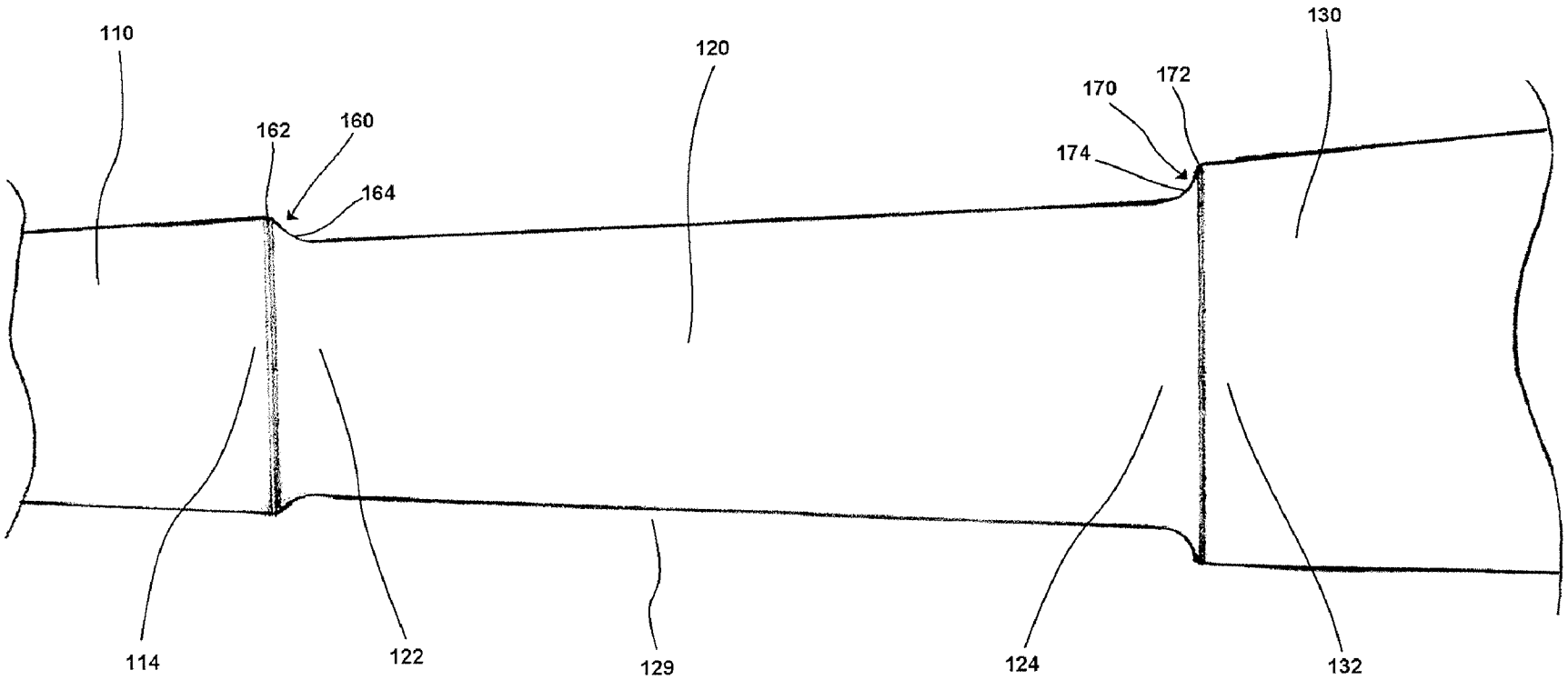
FIG. 2 is a partial plan view of the intermediate region of the improved training bat depicting details of the first circumferential depression and the first and second transition zones.

The improved training bat 1 comprises an adapted intermediate region 120 to accommodate the first training assembly 200. The intermediate region 120 has formed within it a first circumferential depression 129 being substantially uniform in width and depth. See FIG. 2. This results in the diameter at the first end 122 of the intermediate region 120 being smaller than the diameter at the second, adjacent end 114 of the handle region 110 and the diameter at the second end 124 of the intermediate region 120 being smaller than the diameter of the first, adjacent end 132 of the hitting region 130. A first transition zone 160 is located between the second end 114 of the handle region 110 and the first end 122 of the intermediate region 120. The first transition zone 160 has a convex eased edge 162 leading from the second end 114 of the handle region 110 and transitioning to a concave quarter round inside surface 164 leading to the first end 122 of the intermediate region 120, thereby creating a smooth transition surface from the second end 114 of the handle region 110 to the first end 122 of the intermediate region 120. A second transition zone 170 is located between the second end 124 of the intermediate region 120 and the first end 132 of the hitting region 130. The second transition zone 170 has a concave quarter round inside surface 174 leading from the second end 124 of the intermediate region 120 and transitioning to a convex eased edge 172 leading to the first end 132 of the hitting region 130, thereby creating a smooth transition surface from the second end 124 of the intermediate region 120 to the first end 132 of the hitting region 130. Neither the first transition zone 160 nor the second transition zone 170 has any sharp angles or stress points. So configured, the first transition zone 160 and second transition zone 170 avoid introducing points of weakness in the batting core 100, which otherwise could lead to accelerated breakage of the batting core 100 during use. The first training assembly 200 is located over and in contact with the first transition zone 160, the intermediate region 120, and the second transition zone 170, and is fixedly attached to the batting core 100. The rigidity and durability of the first training assembly 200 strengthens the improved training bat 1 in the intermediate region 120, further reducing the likelihood of accelerated breakage.

Figure 3:
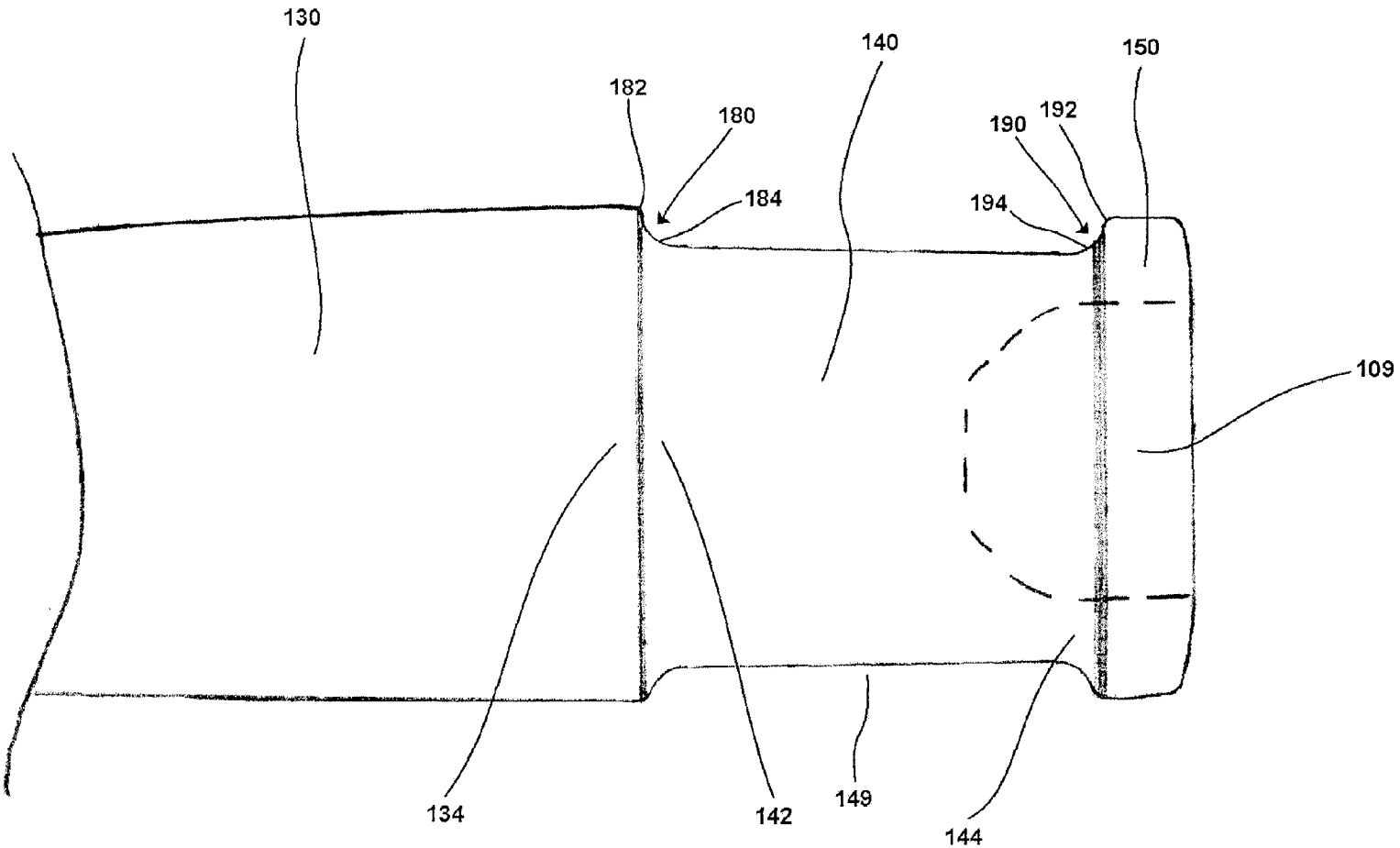
FIG. 3 is a partial plan view of the terminal region of the improved training bat depicting details of the second circumferential depression and the third and fourth transition zones.

The improved training bat 1 likewise comprises an adapted terminal region 140 to accommodate the second training assembly 300. The terminal region 140 has formed within it a second circumferential depression 149 being substantially uniform in width and depth. See FIG. 3. This results in the diameter at the first end 142 of the terminal region 140 being smaller than the diameter at the second, adjacent end 134 of the hitting region 130 and the diameter at the second end 144 of the terminal region 140 being smaller than the diameter of the adjacent end cap 150. A third transition zone 180 is located between the second end 134 of the hitting region 130 and the first end 142 of the terminal region 140. The third transition zone 180 has a convex eased edge 182 leading from the second end 134 of the hitting region 130 and transitioning to a concave quarter round inside surface 184 leading to the first end 142 of the terminal region 140, thereby creating a smooth transition surface from the second end 134 of the hitting region 130 to the first end 142 of the terminal region 140. A fourth transition zone 190 is located between the second end 144 of the terminal region 140 and the end cap 150. The fourth transition zone 190 has a concave quarter round inside surface 194 leading from the second end 144 of the terminal region 140 and transitioning to a convex eased edge 192 leading to the end cap 150, thereby creating a smooth transition surface from the second end 144 of the terminal region 140 to the end cap 150. Neither the third transition zone 180 nor the fourth transition zone 190 has any sharp angles or stress points. The second training assembly 300 is located over and in contact with the third transition zone 180, the terminal region 140, and the fourth transition zone 190, and is fixedly attached to the batting core 100. The rigidity and durability of the second training assembly 300 similarly strengthens the improved training bat 1 in the terminal region 140.

In the preferred embodiment of the present invention, the first and second training assemblies 200,300 are constructed of polyethylene. In other embodiments the first and second training assemblies 200,300 may be constructed of other suitable materials having the required characteristics described above, such as high density polyethylene, ultra high density polyethylene, polypropylene, polystyrene, aluminum, graphite, fiberglass, or other composites. In yet other embodiments the first and second training assemblies 200, 300 may each be constructed of a different material.

In yet another embodiment of the present invention, the batting core 100 further comprises a depression 109 formed into the end cap 150. See FIG. 3. This end depression 109 may be substantially frusto-conical, cylindrical, or some other suitable shape. The end depression 109 is centered about the longitudinal axis of the batting core 100. In yet another embodiment the end depression 109 extends under at least a portion of the terminal region 140. The rigidity and durability of the second training assembly 300 allows the extension of the end depression 109 under the terminal region 140 without risk of accelerated breakage.

Having an end depression 109 formed into the batting core 100 lessens the overall weight of the improved training bat 1. Wooden bats are heavier than aluminum bats of the same length. By incorporating an end depression 109 in the end of the improved training bat 1 (that is, removing some of the mass of the batting core 100), a wooden improved training bat 1 can achieve the same weight-to-length ratio as a standard aluminum bat of the same length. This is a desirable feature for a training bat, as a wooden improved training bat 1 will not cause a ball 10 to travel as far as an aluminum bat of the same length and weight, thereby encouraging the batter to swing harder to achieve desired distances. Where the material out of which the first and second training assemblies 200,300 are constructed is less dense than the material out of which the batting core 100 is constructed, the overall weight of the improved training bat 1 will be reduced simply by replacing portions of the intermediate and terminal region 140 of the batting core 100 with the first and second training assemblies 200,300, respectively. In that case a smaller end depression 109 may be used to achieve the desired weight-to-length ratio.

The present invention also contemplates a method of constructing an improved training bat 1. In one embodiment the method comprises the steps of:

obtaining a substantially elongate, cylindrical, and tapered batting core 100 having a handle region 110, an intermediate region 120 proximate to the handle region 110, a hitting region 130 proximate to the intermediate region 120, a terminal region 140 proximate to the hitting region 130, and an end cap 150 proximate to the terminal region 140;

forming a first circumferential depression 129 in the intermediate region 120 such that the first circumferential depression 129 is substantially uniform in width and depth;

forming a first transition zone 160 in the batting core 100 between the handle region 110 and the intermediate region 120 by creating a convex eased edge 162 adjacent to the second end 114 of the handle region 110 and creating a concave quarter round inside surface 164 leading from the eased edge 162 to the first end 122 of the intermediate region 120;

forming a second transition zone 170 in the batting core 100 between the intermediate region 120 and the hitting region 130 by creating a concave quarter round inside surface 174 adjacent to the second end 124 of the intermediate region 120 and creating a convex eased edge 172 leading from the quarter round inside surface 174 to the first end 132 of the hitting region 130;

forming a second circumferential depression 149 in the terminal region 140 such that the second circumferential depression 149 is substantially uniform in width and depth;

forming a third transition zone 180 in the batting core 100 between the hitting region 130 and the terminal region 140 by creating a convex eased edge 182 adjacent to the second end 134 of the hitting region 130 and creating a concave quarter round inside surface 184 leading from the eased edge 182 to the first end 142 of the terminal region 140;

forming a fourth transition zone 190 in the batting core 100 between the terminal region 140 and the end cap 150 by creating a concave quarter round inside surface 194 adjacent to the second end 144 of the terminal region 140 and creating a convex eased edge 192 leading from the quarter round inside surface 194 to the end cap 150;

forming a first training assembly 200 onto and fixedly attaching it to the batting core 100, with the first training assembly 200 formed over the first transition zone 160, the intermediate region 120, and the second transition zone 170, thereby providing a smooth, continuous surface from the handle region 110 to the hitting region 130; and forming a second training assembly 300 onto and fixedly attaching it to the batting core 100, with the second training assembly 300 formed over the third transition zone 180, the terminal region 140, and the fourth transition zone 190, thereby providing a smooth, continuous surface from the hitting region 130 to the end cap 150.

The steps of forming the circumferential depressions 129, 149 in the intermediate region 120 and terminal region 140, respectively, may be performed in either order. The steps of forming the first, second, third, and fourth transition zones 160,170,180,190 may be performed in any order, provided the first and second transition zones 160,170 are formed after the first circumferential depression 129 in the intermediate region 120 is formed and the third and fourth transition zones 180,190 are formed after the second circumferential depression 149 in the terminal region 140 is formed.

In the preferred embodiment the steps of forming a first circumferential depression 129 in the intermediate region 120 and forming a second circumferential depression 149 in the terminal region 140 are performed by removing a portion of the batting core 100 from the intermediate and terminal region 140*s*, respectively. This may be done by turning the batting core 100 on a lathe. When the batting core 100 is constructed of wood using a lathe to remove portions of the batting core 100 from the intermediate and terminal region 140*s* is most preferred. In other embodiments the batting core 100 may be constructed of metal such as aluminum or composite materials, whereby the circumferential depressions 129,149 may be formed simultaneously with the formation of the batting core 100, such as by the use of molds. Other methods of forming the circumferential depressions 129,149 will be readily apparent to those skilled in the art.

The steps of forming a first training assembly 200 onto and fixedly attaching it to the batting core 100 and forming a second training assembly 300 onto and fixedly attaching it to the batting core 100 may be performed by injection molding polyethylene onto the batting core 100 over the first transition zone 160, the intermediate region 120, and the second transition zone 170, and by injection molding polyethylene onto the batting core 100 over the third transition zone 180, the terminal region 140, and the fourth transition zone 190, respectively.

Alternatively, the steps of forming a first training assembly 200 onto and fixedly attaching it to the batting core 100 and forming a second training assembly 300 onto and fixedly attaching it to the batting core 100 may be performed by placing a heat shrink plastic material over the first transition zone 160, the intermediate region 120, and the second transition zone 170 and then applying heat thereto, and by placing a heat shrink plastic material over the third transition zone 180, the terminal region 140, and the fourth transition zone 190 and then applying heat thereto, respectively. Other methods of forming the training assemblies 200,300 onto the batting core 100 will be readily apparent to those skilled in the art.

In yet another embodiment an additional step of forming an end depression 109 into the batting core 100 is performed. This end depression 109 is formed into the batting core 100 from the end cap 150 and is centered about the longitudinal axis of the batting core 100. The end depression 109 may be substantially frusto-conical, cylindrical, or some other suitable shape. This step of forming the end depression 109 into the end cap 150 of the batting core 100 may be performed at any time relative to the other above-described steps of the method, though it is preferred to be performed prior to the forming and fixation of the training assemblies 200,300 to the batting core 100.

Other variations of the above method are also contemplated, such are applying a finish to the batting core 100 prior to the forming and fixation of the training assemblies 200,300 to the batting core 100, or adding graphic designs to the batting core 100 or training assemblies 200,300, or adding grip assisting material to the handle region 110.

Modifications and variations may be made to the disclosed embodiments of the present invention without departing from the subject or spirit of the present invention as defined in the following claims.

I claim:

1. An improved training bat comprising a batting core, being substantially elongate, cylindrical, and tapered, having a handle region, having a first end, a second end, and a second end diameter, an intermediate region, having a first end, a second end, a first end diameter, and a second end diameter, with the first end of the intermediate region proximate to the second end of the handle region, a hitting region, having a first end, a second end, a first end diameter, and a second end diameter, with the first end of the hitting region proximate to the second end of the intermediate region, a terminal region, having a first end, a second end, a first end diameter, and a second end diameter, with the first end of the terminal region proximate to the second end of the hitting region, an end cap, having a diameter, with the end cap proximate to the second end of the terminal region, a first transition zone, located between the second end of the handle region and the first end of the intermediate region, said first transition zone having a convex eased edge adjacent to the second end of the handle region and a concave quarter round inside surface leading to the first end of the intermediate region, thereby creating a smooth transition from the second end of the handle region to the first end of the intermediate region, said first transition zone having no sharp angles or stress points, a second transition zone, located between the second end of the intermediate region and the first end of the hitting region, said second transition zone having a concave quarter round inside surface adjacent to the second end of the intermediate region leading to a convex eased edge adjacent to the first end of the hitting region and thereby creating a smooth transition from the second end of the intermediate region to the first end of the hitting region, said second transition zone having no sharp angles or stress points, a third transition zone, located between the second end of the hitting region and the first end of the terminal region, said third transition zone having a convex eased edge adjacent to the second end of the hitting region and a concave quarter round inside surface leading to the first end of the terminal region, thereby creating a smooth transition from the second end of the hitting region to the first end of the terminal region, said first transition zone having no sharp angles or stress points, and a fourth transition zone, located between the second end of the terminal region and the end cap, said fourth transition zone having a concave quarter round inside surface adjacent to the second end of the terminal region leading to a convex eased edge adjacent to the end cap and thereby creating a smooth transition from the second end of the terminal region to the end cap, said fourth transition zone having no sharp angles or stress points, wherein the first end diameter of the intermediate region is smaller than the second end diameter of the handle region and the second end diameter of the intermediate region is smaller than the first end diameter of the hitting region, thereby defining a first circumferential depression within the intermediate region, said first circumferential depression being substantially uniform in width and depth, and the first end diameter of the terminal region is smaller than the second end diameter of the hitting region and the second end diameter of the terminal region is smaller than the diameter of the end cap, forming a second circumferential depression within the terminal region, said second circumferential depression being substantially uniform in width and depth; and a first training assembly, constructed of a durable, rigid material which, when struck, emits a sound different from a sound emitted by the batting core when struck, said first training assembly located over and in contact with the first transition zone, the intermediate region, and the second transition zone, thereby providing a smooth, continuous surface from the handle region to the hitting region, said first training assembly being fixedly attached to the batting core; and a second training assembly, constructed of a durable, rigid material which, when struck, emits a sound different from a sound emitted by the batting core when struck, said second training assembly located over and in contact with the third transition zone, the terminal region, and the fourth transition zone, thereby providing a smooth, continuous surface from the hitting region to the end cap, said second training assembly being fixedly attached to the batting core.

2. The improved training bat of claim 1 wherein the first training assembly is constructed of polyethylene.

3. The improved training bat of claim 1 wherein the second training assembly is constructed of polyethylene.

4. The improved training bat of claim 1 wherein the batting core further comprises an end depression formed into the end cap and centered about the longitudinal axis of the batting core.

5. The improved training bat of claim 4 wherein the end depression extends under at least a portion of the terminal region.

6. An improved training bat comprising a batting core, being substantially elongate, cylindrical, and tapered, having a handle region, having a first end, a second end, and a second end diameter, an intermediate region, having a first end, a second end, a first end diameter, and a second end diameter, with the first end of the intermediate region proximate to the second end of the handle region, a hitting region, having a first end, a second end, and a first end diameter, with the first end of the hitting region proximate to the second end of the intermediate region, a first transition zone, located between the second end of the handle region and the first end of the intermediate region, said first transition zone having a convex eased edge adjacent to the second end of the handle region and a concave quarter round inside surface leading to the first end of the intermediate region, thereby creating a smooth transition from the second end of the handle region to the first end of the intermediate region, said first transition zone having no sharp angles or stress points, a second transition zone, located between the second end of the intermediate region and the first end of the hitting region, said second transition zone having a concave quarter round inside surface adjacent to the second end of the intermediate region leading to a convex eased edge adjacent to the first end of the hitting region and thereby creating a smooth transition from the second end of the intermediate region to the first end of the hitting region, said second transition zone having no sharp angles or stress points, wherein the first end diameter of the intermediate region is smaller than the second end diameter of the handle region and the second end diameter of the intermediate region is smaller than the first end diameter of the hitting region, thereby defining a circumferential depression within the intermediate region, said circumferential depression being substantially uniform in width and depth; and a training assembly, constructed of a durable, rigid material which, when struck, emits a sound different from a sound emitted by the batting core when struck, said first training assembly located over and in contact with the first transition zone, the intermediate region, and the second transition zone, thereby providing a smooth, continuous surface from the handle region to the hitting region, said training assembly being fixedly attached to the batting core.

7. The improved training bat of claim 6 wherein the training assembly is constructed of polyethylene.

8. The improved training bat of claim 6 wherein the batting core further comprises an end depression formed into the second end of the hitting region and centered about the longitudinal axis of the batting core.

9. A method of constructing an improved training bat comprising the steps of:

(1) obtaining a batting core, said batting core being substantially elongate, cylindrical, and tapered and having a handle region, having a first end and a second end, an intermediate region, having a first end and a second end, with the first end of the intermediate region being proximate to the second end of the handle region, a hitting region, having a first end and a second end, with the first end of the hitting region being proximate to the second end of the intermediate region, a terminal region, having a first end and a second end, with the first end of the terminal region being proximate to the second end of the hitting region, and an end cap, with the end cap being proximate to the second end of the terminal region;

(2) performing the following three steps in the order of first performing step (A) and then performing steps (B) and (C) in either order:

(A) forming a first circumferential depression in the intermediate region such that said first circumferential depression is substantially uniform in width and depth, (B) forming a first transition zone in the batting core between the second end of the handle region and the first end of the intermediate region by creating a convex eased edge adjacent to the second end of the handle region and creating a concave quarter round inside surface leading from the eased edge to the first end of the intermediate region, and (C) forming a second transition zone in the batting core between the second end of the intermediate region and the first end of the hitting region by creating a concave quarter round inside surface adjacent to the second end of the intermediate region and creating a convex eased edge leading from the quarter round inside surface to the first end of the hitting region;

(3) performing the following three steps in the order of first performing step (A) and then performing steps (B) and (C) in either order:

(A) forming a second circumferential depression in the terminal region such that said second circumferential depression is substantially uniform in width and depth, (B) forming a third transition zone in the batting core between the second end of the hitting region and the first end of the terminal region by creating a convex eased edge adjacent to the second end of the hitting region and creating a concave quarter round inside surface leading from the eased edge to the first end of the terminal region, and (C) forming a fourth transition zone in the batting core between the second end of the terminal region and the end cap by creating a concave quarter round inside surface adjacent to the second end of the terminal region and creating a convex eased edge leading from the quarter round inside surface to the end cap;

(4) forming a first training assembly onto and fixedly attaching it to the batting core, said first training assembly being constructed of a durable, rigid material which, when struck, emits a sound different from a sound emitted by the batting core when struck, said first training assembly formed over the first transition zone, the intermediate region, and the second transition zone, thereby providing a smooth, continuous surface from the handle region to the hitting region; and (5) forming a second training assembly onto and fixedly attaching it to the batting core, said second training assembly being constructed of a durable, rigid material which, when struck, emits a sound different from a sound emitted by the batting core when struck, said second training assembly formed over the third transition zone, the terminal region, and the fourth transition zone, thereby providing a smooth, continuous surface from the hitting region to the end cap.

10. The method of claim 9 wherein Steps (2) and (3) may be performed in either order.

11. The method of claim 9 wherein Steps (4) and (5) may be performed in either order.

12. The method of claim 9 wherein Steps (2) and (5) may be performed in either order, provided Step (5) is performed after Step (3).

13. The method of claim 9 wherein Steps (3) and (4) may be performed in either order, provided Step (4) is performed after Step (2).

14. The method of claim 9 wherein Step (2)(A) is performed by removing a portion of the batting core from the intermediate region.

15. The method of claim 9 wherein Step (3)(A) is performed by removing a portion of the batting core from the terminal region.

16. The method of claim 9 wherein Step (4) is performed by injection molding polyethylene onto the batting core over the first transition zone, the intermediate region, and the second transition zone.

17. The method of claim 9 wherein Step (5) is performed by injection molding polyethylene onto the batting core over the third transition zone, the terminal region, and the fourth transition zone.

18. The method of claim 9 wherein Step (4) is performed by placing a heat shrink plastic material onto the batting core over the first transition zone, the intermediate region, and the second transition zone and then applying heat thereto.

19. The method of claim 9 wherein Step (5) is performed by placing a heat shrink plastic material onto the batting core over the third transition zone, the terminal region, and the fourth transition zone and then applying heat thereto.

20. The method of claim 9 further comprising the step of forming an end depression into the batting core from the end cap, said end depression centered about the longitudinal axis of the batting core, said step performed at any time relative to the Steps (1)-(5).

* * * * *